United States Patent [19]

Steinmetz

[11] 4,066,859

[45] Jan. 3, 1978

[54] MERCURY WETTABLE CONTACT ASSEMBLY

[75] Inventor: Anthony Steinmetz, Hilversum, Netherlands

[73] Assignee: U.S. Philips Corporation, New York, N.Y.

[21] Appl. No.: 688,543

[22] Filed: May 21, 1976

[30] Foreign Application Priority Data

May 26, 1975 Netherlands ..... 7506140

[51] Int. Cl.[2] ..... H01H 1/08; H01H 29/00

[52] U.S. Cl. ..... 200/263; 200/234; 200/235; 200/267; 200/268; 335/58

[58] Field of Search ..... 200/234, 262, 263, 267–270, 200/266, 235; 335/49, 201, 58

[56] References Cited

U.S. PATENT DOCUMENTS

| | | | |
|---|---|---|---|
| 2,339,676 | 1/1944 | Bucklen, Jr. | 335/201 X |
| 2,547,536 | 6/1948 | Pollard, Jr. | 200/234 X |
| 3,144,533 | 8/1964 | Donath | 200/234 X |
| 3,155,804 | 11/1964 | Gewirtz | 200/266 |
| 3,644,693 | 2/1972 | Bitko | 200/234 X |

*Primary Examiner*—James R. Scott

*Attorney, Agent, or Firm*—Frank R. Trifari; Rolf E. Schneider

[57] ABSTRACT

A switching device comprising a movable blade wetted with a liquid metal, and a stationary blade having a surfacelayer of a non-metallic material which is not wetted by the liquid metal.

9 Claims, 1 Drawing Figure

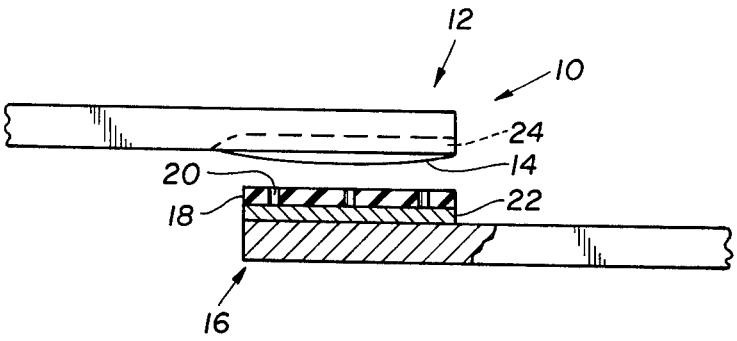
12
10
24
14
20
22
18
16

MERCURY WETTABLE CONTACT ASSEMBLY

BACKGROUND OF THE INVENTION

This invention relates to a switching device having a movable contact tongue or blade, wetted with a liquid metal, such as a switch or a relay in a sealed envelope.

SUMMARY OF THE INVENTION

When a switching device must satisfy the most stringent requirements as regards load, life and stability of the contact resistance, mercury is used as the contacting material in known switchng devices. In such a switch the mercury is usually enclosed within a glass tube. Contact is made by the displacement of a drop of liquid or by means of moving, mercury-wetted contacts. In the latter type it is necessary to store mercury in the envelope which keeps the surface of the contacting element moist by means of capillary action. This is necessary to replenish the mercury which disappears from the contact area due to evaporation.

The material which is in contact with the liquid contacting metal is chosen such that it does not react in a disturbing manner with it at the working temperature. It is recommended to choose metals which are easily wetted by the liquid metal alloy, for example by means of a temperature treatment, such as molybdenum, nickel, iron, tantalum, niobium or rhenium.

The invention provides a switching device which is simple of construction, as is a professional reed contact in an hermetically sealed envelope and which device is yet cheap and has a low constant contact resistance which is independent of the contacting force, high loadability, low rebound and which can be used for a great number of switching actions.

BREIF DESCRIPTION OF THE DRAWING

The sole FIGURE illustrates a mercury wettable contact assembly.

DESCRIPTION OF THE PREFERRED EMBODIMENTS

As shown in the accompanying drawing, the switching device 10 has a movable contact tongue or blade 12 wetted with a liquid metal 14 and includes a stationary contact tongue or blade 16 having a surface layer 18 consisting of a non-metallic material which is not wetted by the liquid metal.

A very suitable non-metallic material consists of graphite which is applied, by means of vacuum coating or cathodic voltilisation in a thin layer of between 0.1 and 10$\mu$.

According to another embodiment of the invention, the stationary contact tongue 16 is coated with a layer 0.1 – 10$\mu$ thick consisting of such a non-metallic material 18 which is insulating and comprises one or more holes 20 having a maximum size of $10^5\mu^2$ thereby partially leaving uncovered the subjacent metal in situ of the contact area.

It is advantageous to have an intermediate layer 22, approximately 100$\mu$m thick, consisting of a non-magnetizable metal such as Mo on the wetted contact tongue and/or on the stationary contact tongue between the magnetizable metal contact material and the liquid metal, or the non-metallic material respectively. The presence of the intermediate layer may influence the required number of ampere turns for energizing and de-energizing.

The subjacent metal of the stationary contact tongue is preferably well-wetted by the liquid metal of the opposite contact. This consists, for example, of nickel iron.

The insulating material which is present of the stationary contact tongue may inter alia be quartz glass, alundum or another glass, which is also applied by means of vacuum coating or cathodic volatilisation.

The hole or holes in the insulating material may be provided therein by means of high-voltage breakdown.

The metal-wetted movable contact tongue is desirably provided with grooves 24, preferably in the longitudinal direction. These grooves may be formed by means of swaging. They ensure a stock of the liquid metal which serves to replenish the used metal.

When the above contact material is used the contact tongues are first tinplated, for example by means of electrodeposition or by sputtering, before the mercury is applied in order to obtain a better wetting action.

By means of the invention, a switching device is obtained which is rather simple of construction and which has a life as regards the obtainable number of switching actions in the unloaded and the loaded state which is considerably higher than has been realized so far with this type of device.

By way of non-limitative example an illustration of a device according to the invention, follows herebelow.

Contact blades or tongues are cut from a wire which is composed of 50% by weight of Fe - 50% by weight of Ni, having a diameter of 0.6 mm the ends of which are flattened over a length of 5 mm into a rectangular shape having a width of 2 mm and a thickness of 0.35 mm.

Two of these contact blades are sealed into a glass tube having a thickness of 3.4 mm and a length of 21 mm, the distance between the contact blades being 100$\mu$m.

Beforehand one of the contact blades is wetted with tin and thereafter with mercury. A quartz glass layer, 0.2$\mu$m thick is sputtered onto the other contact blade and holes are made in this layer by means of a few high tension breakdowns.

The spring characteristic is 80 g/mm. The exciting energy is 30 ampere-turns, the drop-out energy 8 ampere-turns.

Life tests proved that such a switching device keeps a low resistance during more than $10^8$ switching actions in the unloaded state.

What is claimed is:

1. A switching device which comprises a moveable contact blade formed of a magnetizable metal and having a contact surface wetted with a liquid metal, and a stationary contact blade formed of a magnetisable metal and having on its contact surface a layer consisting of a non-metallic material that is not wetted by the liquid metal.

2. A switching device according to claim 1, in which the non-metallic material consists of an insulating material provided with at least one hole extending therethrough and having a maximum size of $10^5\mu^2$.

3. A switching device according to claim 1, in which an intermediate layer approximately 100$\mu$m thick of a non-magnetizable metal is provided between the contact surface of the movable blade and the liquid metal.

4. A switching device according to claim 3, in which the non-magnetizable metal is molybdenum.

5. A switching device according to claim 1, in which an intermediate layer approximately 100μm thick of a non-magnetizable metal is provided between the contact surface of the stationary blade and the non-metallic material layer.

6. A switching device according to claim 5, in which the non-magnetizable metal is molybdenum.

7. A switching device according to claim 1, in which the contact surface of the movable blade is provided with grooves.

8. A switching device according to claim 7, in which said grooves extend longitudinally of the movable blade contact surface.

9. A switching device according to claim 1, in which the liquid metal is mercury.

* * * * *